US005423161A

United States Patent [19]

Huson et al.

[11] Patent Number: 5,423,161

[45] Date of Patent: Jun. 13, 1995

[54] METHOD FOR WRAPPING ELONGATE LOAD WITH WRAPPING FILM, APPARATUS THEREFOR, AND FILM-PERFORATING MECHANISM

[75] Inventors: Gale W. Huson, Glenview; Hugo Boeckmann, Arlington Heights, both of Ill.; Werner K. Diehl, Parkland; Stanford Stone, Fort Lauderdale, both of Fla.

[73] Assignee: Mima Incorporated, Glenview, Ill.

[21] Appl. No.: 306,850

[22] Filed: Sep. 15, 1994

Related U.S. Application Data

[63] Continuation of Ser. No. 969,586, Oct. 30, 1992.

[51] Int. Cl.[6] ..... B65B 11/58

[52] U.S. Cl. ..... 53/449; 53/399; 53/441; 53/556; 53/176; 53/586; 53/588; 53/133.8

[58] Field of Search ..... 83/660, 946; 53/133.8, 53/176, 371.4, 374.4, 376.2, 381.2, 399, 441, 449, 556, 586, 587, 588

[56] References Cited

U.S. PATENT DOCUMENTS

| | | | |
|---|---|---|---|
| 2,051,922 | 8/1936 | Vogt | 53/133.8 X |
| 2,729,885 | 1/1956 | Wahl et al. | 53/381.2 X |
| 2,978,007 | 4/1961 | Jensen | 53/371.4 |
| 3,064,403 | 11/1962 | Tokos et al. | 53/371.4 X |
| 3,075,326 | 1/1963 | Waite | 53/371.4 X |
| 3,212,381 | 10/1965 | Heyer | 53/133.8 X |
| 3,672,116 | 6/1972 | Ingmarson | 53/441 x |
| 3,999,357 | 12/1976 | Marantz | 53/449 X |
| 4,167,841 | 9/1979 | Camp | 53/399 |
| 4,317,322 | 3/1982 | Lancaster et al. | 53/399 |
| 4,413,463 | 11/1983 | Lancaster | 53/399 |
| 4,635,316 | 1/1987 | Towne et al. | 83/660 X |
| 4,655,028 | 4/1987 | Silbernagel | 53/441 X |
| 4,712,354 | 12/1987 | Lancaster et al. | 53/176 X |
| 4,730,436 | 3/1988 | Angelino | 53/176 X |
| 4,765,120 | 8/1988 | Phillips | 53/441 |
| 5,027,579 | 7/1991 | Keip | 53/588 X |
| 5,067,306 | 11/1991 | Umezawa | 53/133.8 X |
| 5,182,894 | 2/1993 | Bate | 53/449 X |

FOREIGN PATENT DOCUMENTS

| | | | |
|---|---|---|---|
| 2448720 | 4/1975 | Germany | 53/449 |

*Primary Examiner*—John Sipos
*Assistant Examiner*—Daniel Moon
*Attorney, Agent, or Firm*—Schwartz & Weinrieb

[57] ABSTRACT

A method and apparatus are disclosed for wrapping a load conforming generally to a rectangular solid, such as a cotton bale. Lengths of wrapping film from two rolls are welded to form a predraped wall of such film, into which the load is conveyed to cover its front face and its lateral faces, whereupon the welded lengths are welded again behind the bale and are severed from such rolls. As the load is conveyed, a length of wrapping film from a third roll is wrapped in a spiral pattern so as to cover the upper, lower, and lateral faces of the load. Moreover, generally V-shaped perforations pointing toward the front face are formed in the lateral faces, by means of perforating mechanisms. Each mechanism comprises a pivotal arm biased toward the load, a wheel rotatable on the arm, and perforating cutters extending radially from the wheel, in two circumferential arrays.

22 Claims, 4 Drawing Sheets

100
110
112
114
116
118
120
122
130
132
138
140
150
152
156
170
172
174
176
180
182
184
186
210
216
228
230
250
252
254
256
258
270
272
276
278
280
282
290
292
294

Fig. 11
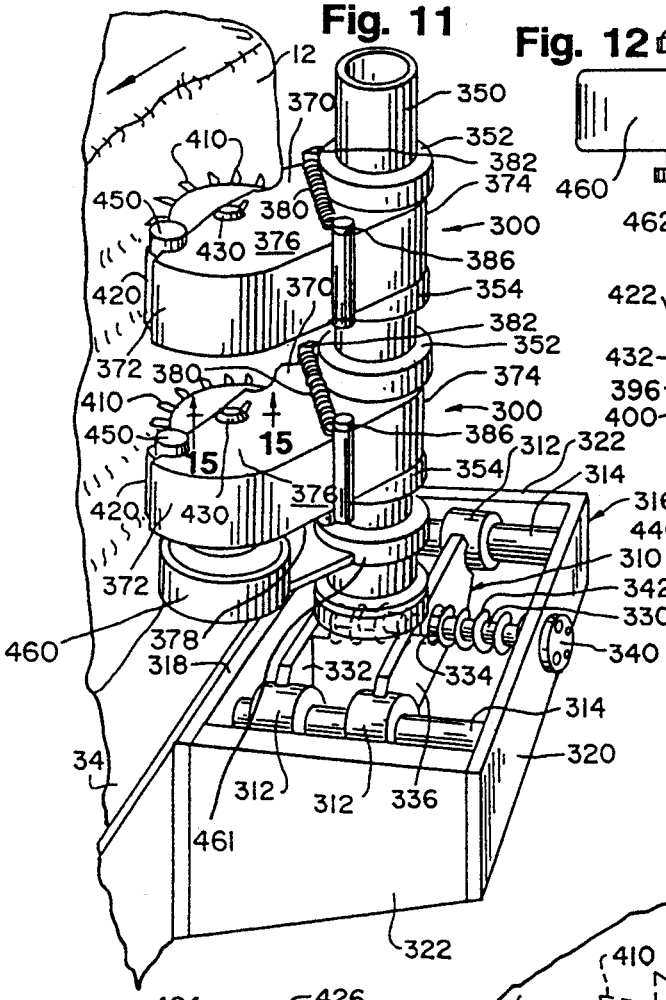
Fig. 12
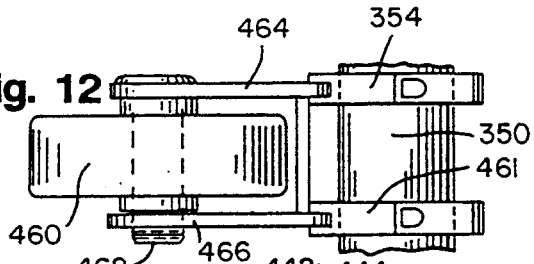
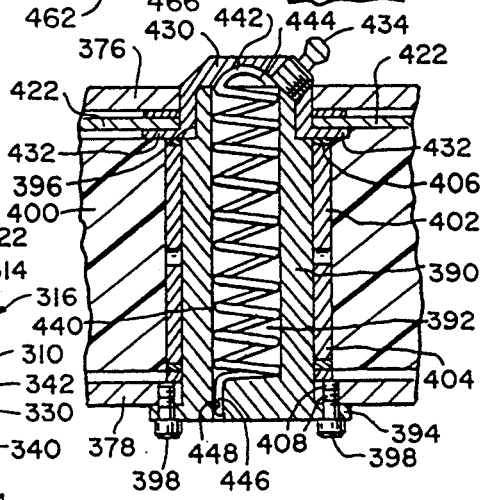
Fig. 15
Fig. 14
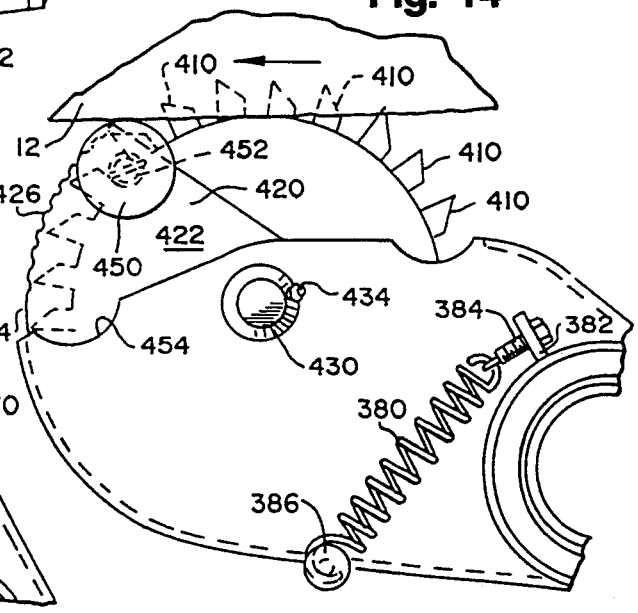
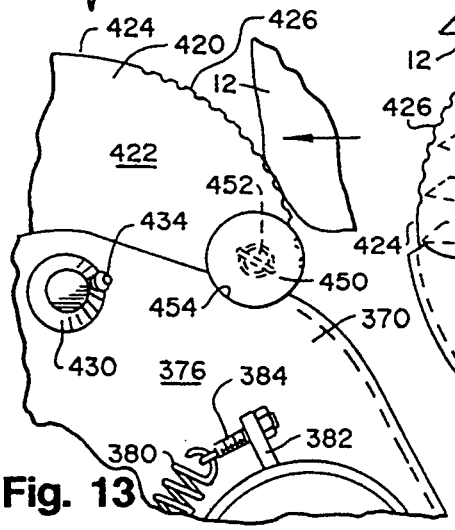
Fig. 13

METHOD FOR WRAPPING ELONGATE LOAD WITH WRAPPING FILM, APPARATUS THEREFOR, AND FILM-PERFORATING MECHANISM

This application is a continuation of application Ser. No. 07/969,568, filed Oct. 30, 1992.

TECHNICAL FIELD OF THE INVENTION

This invention pertains to an improved method for wrapping an elongate load, such as a cotton bale, with wrapping film and to an improved apparatus therefor. This invention also pertains to a film-perforating mechanism of related interest.

BACKGROUND OF THE INVENTION

In cotton baling, common practices are to wet a cotton bale before compressing it so that cotton fibers in the wetted bale are limp, to compress the wetted bale, to tie the compressed bale with steel strapping or wire ties, and to wrap the tied bale for storage and shipment. It is known for other fibers to be similarly baled with or without a wetting step.

Commonly, water vapor-pervious bags of nonwoven polypropylene are used to wrap the tied bales. Water vapor-pervious bags are used to permit humidity within such bags to equilibrate with humidity outside such bags in the storage and shipment environments.

Usage of such bags is problematic, however, since it is difficult to dispose of such bags, which are bulky and occupy large spaces in landfills. Recycling of such bags may not be economically feasible.

There has been a need, to which this invention is addressed, for a better way to wrap such a bale.

SUMMARY OF THE INVENTION

According to this invention, a method and related apparatus are provided for wrapping an elongate load conforming generally to a rectangular solid, such as a bale of cotton or other fibers, with wrapping film from first, second, and third rolls. The elongate load has a front face, a back face, an elongate, upper face, an elongate, lower face, and two elongate, lateral faces. The first and second rolls are rotatable about fixed, parallel axes, preferably horizontal axes. Broadly, the method and related apparatus operate in a manner to be next described, so that all of these load faces are covered with film.

A length of film from the first roll and a length of film from the second roll are welded to each other so as to form a predraped wall of wrapping film having a welded seam. The load is conveyed longitudinally into the predraped wall of film, in a frontward direction, so as to cover the front face and two of the elongate faces with film from the welded lengths.

The welded lengths of film are welded again to each other so as to form a welded seam behind the load, and so as to cover the back face with film from the welded lengths. The lengths of film are severed from the first and second rolls, near the welded seam behind the load.

A length of film from the third roll is wrapped in a spiral pattern around the load, over the film covering the elongate faces, so as to cover the upper, lower, and lateral faces of the load with film from the third roll. This may be advantageously done while the load is being conveyed in the frontward direction.

Preferably, the film wrapped around the load is welded to the next underlying layer of at least in some areas along one of the covered, elongate faces, while the load is being conveyed in the frontward direction. It is preferred that the film lengths welded again to each other are welded so as to form two spaced, parallel, welded seams behind the load and are severed from the first and second rolls between the welded seams behind the load.

Preferably, the film is perforated along at least one of the elongate faces of the load while the load is being conveyed in the frontward direction. It is preferred that the film is perforated along the lateral faces, particularly but not exclusively if the upper and lower faces are covered with film from the welded lengths from the first and second rolls.

Furthermore, a perforating mechanism is provided, which may be advantageously used for perforating the film, as mentioned above. Broadly, the perforating mechanism comprises a base supported near the load, an elongate structure mounted pivotally to the base, a perforating wheel mounted rotatably to the elongate structure, and multiple perforating cutters, each extending radially from the perforating wheel.

The elongate structure has a proximal end, near which the elongate structure is mounted pivotally to the base, and a distal end. The elongate structure is mounted for pivotal movement about an axis in an inward direction so as to move the distal end toward the load and in an outward direction so as to move the distal end away from the load. The elongate structure is biased in the inward direction. The perforating wheel is mounted rotatably to the arm, near the distal end, and is rotatable about an axis parallel to the axis of pivotal movement of the elongate structure.

Each cutter may be advantageously shaped so as to form a generally V-shaped perforation in the film wrapping the load. Preferably, each cutter is oriented so as to form such a perforation pointing axially. The cutters may be advantageously arranged in two circumferential arrays spaced axially from each other. Preferably, the cutters of one such array alternate with the cutters of the other array around the perforating wheel.

Two different embodiments of the perforating mechanism are contemplated. In one contemplated embodiment, the base is arranged to be manually adjustable to a desired position near the load. In a preferred embodiment, the base is mounted so as to be movable toward and away from the load and is biased toward the load. In the preferred embodiment, the perforating mechanism may be advantageously combined with a positioning wheel supported rotatably by the base and adapted to engage a load as the load is conveyed past the perforating mechanism. In either such embodiment, the perforating mechanism may be advantageously combined with a similar mechanism comprising the same base.

BRIEF DESCRIPTION OF THE DRAWINGS

These and other objects, features, and advantages of this invention will become evident from the following description of a preferred embodiment of this invention with reference to the accompanying drawings, in which like reference characters designate like or corresponding parts throughout the several views, and wherein:

FIG. 11 is a fragmentary, perspective view of a pair of perforating mechanisms according to a preferred design useful in the wrapping apparatus. A wrapped load is shown fragmentarily.

FIG. 12, on a larger scale, is a fragmentary, elevational view of a guiding wheel associated with the pair of perforating mechanisms of FIG. 11.

FIGS. 13 and 14, on a similar scale, are fragmentary, plan views showing certain elements of one of the perforating mechanisms of FIG. 11, respectively before and during their engagement with a wrapped load.

FIG. 15 is an enlarged, fragmentary, cross-sectional view taken along line 15—15 of FIG. 11, in a direction indicated by the arrows.

DETAILED DESCRIPTION OF ILLUSTRATED EMBODIMENTS

Figure 1:
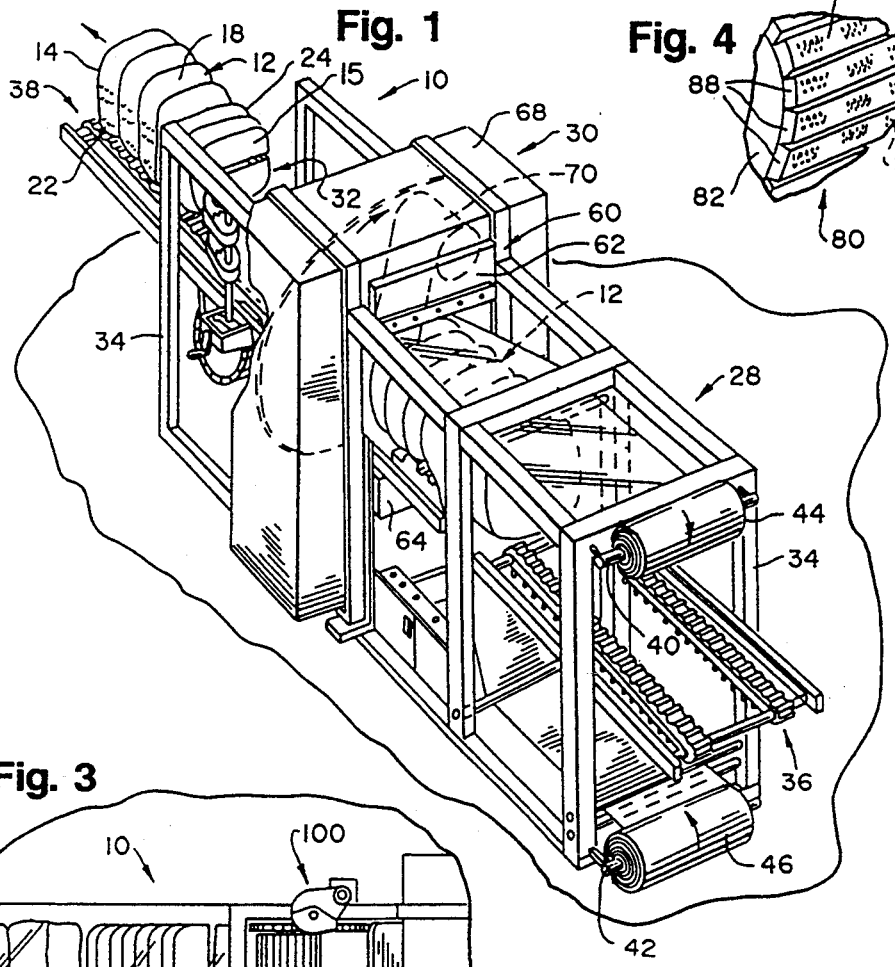
FIG. 1 is a simplified, perspective view of a wrapping apparatus according to this invention, as used for wrapping a cotton bale with wrapping film.
Figure 3:
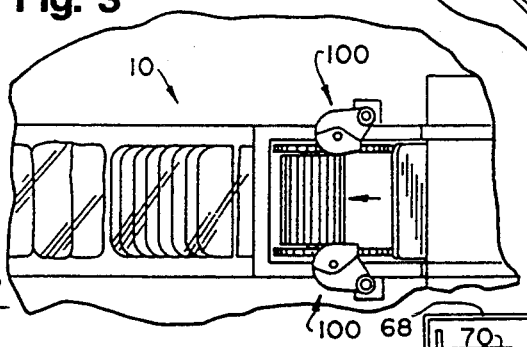
FIG. 3 is a simplified, plan view of one end portion of the wrapping apparatus.
Figure 2:
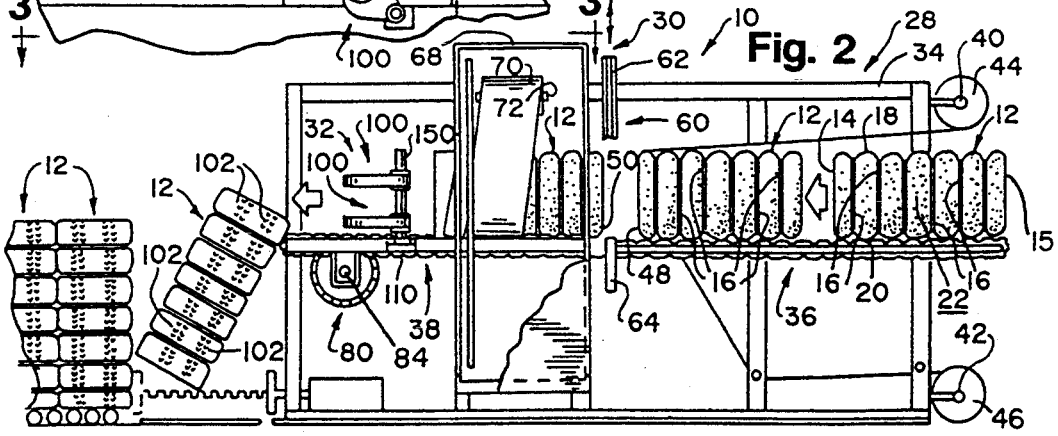
FIG. 2 is a simplified, elevational view of the wrapping apparatus.

As shown in FIGS. 1, 2, and 3, a wrapping apparatus 10 constitutes a preferred embodiment of this invention. The apparatus 10 is shown as used to wrap a series of cotton bales 12 with wrapping film. Conforming generally to a rectangular solid, each bale 12 has a front face 14, a back face 15, an elongate, upper face 18, an elongate, lower face 20, and two elongate, lateral faces 22, 24, all of which are wrapped by the apparatus 10. Each bale 12 is tied with steel or plastic straps 16 in a known manner, before such bale 12 is wrapped by the apparatus 10.

Herein, the terms "front", "back", "upper", "lower", and "lateral" refer to a load, such as a cotton bale 12, in the apparatus 10. As explained below, when a wrapped load 12 leaves the apparatus 10, its front face becomes its bottom face, and its other faces are reoriented accordingly.

Although the apparatus 10 is shown as used to wrap cotton bales, the apparatus 10 may be also used to wrap bales of other fibers, as well as other similar or dissimilar loads.

Any stretch film that can be heat-welded to itself is useful in the apparatus 10. Desirably, for wrapping cotton bales and similar loads, the film is abrasion-resistant, at least at its outer surface.

The apparatus 10, which has a predraping and wrapping section 28, a spiral wrapping section 30, and a welding and perforating section 32 comprises a framework 34 supporting an inlet conveyor 36 and an outlet conveyor 38. Each of the conveyors 36, 38, is of a conventional type comprising two endless belts driven by a motor (not shown) in a conventional manner.

At the predraping and wrapping section 28, the framework 34 supports a first, upper spindle 40 and a second, lower spindle 42, which is disposed below the first spindle 40. The spindles 40, 42, define parallel axes. A first, upper roll 44 of wrapping film is mounted on the first spindle 40 so as to be freely rotatable (except for frictional drag) about the axis defined by the first spindle 40. A second, lower roll 46 of wrapping film is mounted on the second spindle 42 so as to be similarly rotatable on the second spindle 42. A dancer bar (not shown) of a conventional type may be also provided, which is mounted so as to receive film from the first roll 42 and so as to pay out such film freely.

As shown in FIG. 2, a length of film pulled from the first roll 44 and paid out by the dancer bar noted above, if provided, and a length of film pulled from the second roll 46 are welded to each other so as to form a predraped wall of film having a welded seam 48. As shown, the welded seam 48 extends transversely across the front face 14 of the bale 12 to be next wrapped, near the lower face 20 of such bale 12.

The bale 12 to be next wrapped is conveyed by the inlet conveyor 36, in a frontward direction indicated by wide arrows in FIG. 2 so that its front face 14 precedes, into the predraped wall of film so as to cover its front face 14, its upper face 18, and its lower face 20 with film from the lengths pulled from the first and second rolls 44, 46, and welded to each other.

After the bale 12 being wrapped has been conveyed by the inlet conveyor 36 for a sufficient distance for its front, upper, and lower faces to be so covered, the length of film pulled from the first roll 44 and the length of film pulled from the second roll 46 are welded again to each other so as to form a welded seam 50 behind such bale 12, and so as to cover the back face 15 of such bale 12 with film from the welded lengths. As shown, the welded seam 50 extends transversely across the back face 15 of such bale 12, near the lower face 20 of such bale 12.

The welded seam 50 of the film wrapping the back face 15 of the bale 12 being wrapped and the welded seam 48 of the film forming a predraped wall into which the bale 12 to be next wrapped may then be conveyed, are formed simultaneously. Also, the welded lengths are severed between such simultaneously formed welds, approximately when those welds are formed.

As shown in FIG. 2, a welding and severing mechanism 60 of a type known heretofore in wrapping apparatus employing predraped film is provided. The head 62 is arranged to reciprocate into and from a gap between the inlet and outlet conveyors 36, 38, for welding the lengths of film pulled from the first and second rolls 44, 46, to each other at such simultaneously formed welds and for severing the welded lengths between such welds. The mechanism 60 comprises a welding and cutting head 62, which is arranged to be vertically reciprocatable in a manner suggested by a double-headed arrow in FIG. 2, and an anvil 64, which is disposed in a fixed position below the head 62. The inlet and outlet conveyors 36, 38, are stopped for a brief time, while the mechanism 60 is operated.

The predraping and wrapping section 28 is similar to known wrapping apparatus employing shrink film (rather than stretch film) on rolls similar to the rolls 44, 46, and employing dancer bars similar to the dancer bar mentioned hereinbefore, conveyors similar to the inlet conveyor 36, and mechanisms similar to the welding and severing mechanism 60, as available commercially from Arpac Corporation of Schiller Park, Ill.

At the spiral wrapping section 30, the apparatus 10 is enclosed within a protective enclosure 68, which is configured so as to permit a bale 12 to be conveyed through the spiral wrapping section 30. Within the protective enclosure 68, a third roll 70 of wrapping film is mounted on a spindle 72 so as to be freely rotatable (except for frictional drag) on an axis defined by the spindle 72. The spindle 72 is mounted to a spiral wrapping mechanism (not shown) of a type known heretofore and operable to move the spindle 72 around a cylindrical path suggested by a curved arrow in FIG. 1. The spiral wrapping mechanism is operated so that a length of film from the third roll 70 can be wrapped in a spiral pattern overlapping itself, around the bale 12 being wrapped, over the film covering the upper and lower faces 18, 20, of such bale 12, as such bale 12 is conveyed through the spiral wrapping section 30 by the outlet conveyor 38.

The spiral wrapping section 30 is similar to known wrapping apparatus employing stretch film on rolls similar to the third roll 70 and comprising enclosures similar to the protective enclosure 68, and conveyors similar to the outlet conveyor 38, mechanisms similar to the spiral wrapping mechanism mentioned in the preceding paragraph, as available commercially from ITW Mima, supra, under the trade description "MSB Mima Stretch Bundler."

Figure 4:
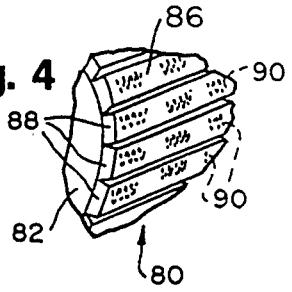
FIG. 4 is a fragmentary, perspective detail view of a welding mechanism used in the wrapping apparatus.

In the welding and perforating section 32, into which the outlet conveyor 38 extends, the apparatus 10 comprises a welding mechanism 80 below and between the endless belts of the outlet conveyor 38. The welding mechanism 80 comprises a drum 82 mounted rotatably on a spindle 84 extending transversely below the outlet conveyor 38 and a circumferential array of heaters 86 (see FIG. 4) extending transversely. Each heater 86 comprises a bar 88 of electrically insulative material (which may be polymeric) and a plurality of electrical resistance heaters 90 spaced transversely along the bar and covered by electrically insulative material of the bar 88. The bars 88 are arranged to engage the lower face 20 of a bale 12 being conveyed over the welding mechanism 80, so as to rotate the dream 82, whereupon the respective heaters 90 weld the spiral wrapped film to the next underlying layer of film along the lower face 20 of the bale 12. Thus, the spiral wrapped film is welded to the underlying film in spaced areas along transverse stripes corresponding to the bars 88, in successive areas along the lower face 20.

Mechanisms similar to the welding mechanism 80 are used for different purposes in wrapping apparatus known heretofore, as available commercially from ITW Mima, supra.

In the welding and perforating section 32, the apparatus 10 comprises two pairs of perforating mechanisms 100, respectively above and to each side of the outlet conveyor 38. The mechanisms 100 are arranged to perforate the film covering the lateral faces 22, 24, of a bale 12, so as to form horizontal rows of generally V-shaped perforations 102 pointing frontwardly. The perforations 102 permit humidity within the film wrapping the bale 12 to equilibrate with humidity outside such film.

As shown in FIG. 2, the apparatus 10 is arranged to eject a wrapped bale 12 so that the wrapped bale 12 is rotated by one quarter-turn, and so that the wrapped bale 12 stands on the face that had been its front face 14. Thus, since the perforations 102 are generally V-shaped and point toward such face 14, the perforations 102 impede infiltration of rain or snow if the wrapped bale 12 happens to be stored outdoors while standing on such face 14.

As a bale 12 is conveyed into the predraping and wrapping section 30 by the inlet conveyor 36, the bale 12 is wrapped at its front, upper, lower, and back faces with film from the first and second rolls 44, 46. After the mechanism 60 is operated, the bale 12 is conveyed by and from the inlet conveyor 36 to and onto the outlet conveyor 38, which continues to convey the bale 12. As the bale 12 is conveyed through the spiral wrapping station 30 by the outlet conveyor 38, the bale 12 is wrapped around its upper, lower, and lateral faces by film from the third roll 70. Thus, all faces of the bale 12 are wrapped with film, so as to cover every area of each face with one or more layers of film. The special wrapped film is welded to the underlying film, as discussed above, so as to integrate the spiral wrapped film and the underlying film into an integrated wrapper for the wrapped bale 12. The integrated wrapper has perforations 102, which permit humidity within the wrapper to equilibrate with humidity outside the wrapper, but which impede infiltration of rain.

The perforating mechanisms 100 of the nearer pair shown in FIGS. 1, 2, and 3 are illustrated in greater detail in FIGS. 5 through 10 and are described hereinbelow. The perforating mechanisms 100 of the farther pair shown in FIGS. 1, 2, and 3 are similar to those of the nearer pair but have structures that may be generally characterized as right-handed, whereas the perforating mechanisms 100 of the nearer pair have structures that may be generally characterized as left-handed. Hereinbelow, all references to the perforating mechanisms 100 refer to the perforating mechanisms 100 of the nearer pair, with reference to FIGS. 5 through 10.

The perforating mechanisms 100 are mounted operatively to a base 110. The base 110 has two pairs of sleeve portions 112, which are mounted slidably on two parallel bars 114. The bars 114 are mounted to the framework 34 of the apparatus 10 so as to extend laterally from the framework 34. A box-like frame 116 including an inner member 118, an outer member 120, and two members 122 extending laterally between the inner and outer members 118, 120 is affixed to the bars 114. When engaged by the sleeve portions 112 of the base 110, the inner and outer members 118, 120 limit sliding movement of the base 110 inwardly and outwardly on the bars 114.

A worm 130 having an external thread 132 is threaded through a bore 134 having an internal thread 136 and extending through the base 110. The worm 130 is journalled to the inner and outer members 118, 120 and extends outwardly beyond the outer member 120. A crank handle 138 having a foldable extension 140 is mounted to the worm 130, beyond the outer member 120, so as to be conjointly rotatable with the worm 130. By means of the crank handle 138, the worm 130 can be manually rotated so as to slide the base 110 inwardly or outwardly along the bars 114, along with the perforating mechanisms 100 mounted operatively to the base 110.

A tubular post 150 defining a vertical axis extends upwardly from the base 110. The perforating mechanisms 100 are mounted on the post 150, in vertically spaced relation to each other, so as to be independently pivotable about the axis defined by the post 150. Each perforating mechanism 100 is mounted on the post 150, between two clamps associated with such perforating mechanism 100, namely an upper clamp 152 and a lower clamp 154. The upper clamp 152 comprises two generally C-shaped clamping elements 156 held together by screws 158 (one shown). The lower clamp 154 comprises two similar clamping elements 160 held together by screws 162 (one shown). A retaining ring 164 is fitted into an annular slot 166 in the post 150, beneath the clamping elements 160 of the lower clamp 152.

Moreover, each perforating mechanism 100 comprises an elongate housing structure 170 having a distal end 172 (see FIGS. 5 and 6) and a proximal end 174, near which such structure 170 is mounted pivotally on the post 150. The elongate housing structure 170 comprises an upper wall 176, a lower wall 178, an inner wall 180, and an outer wall 182. The outer wall 182 has a planar portion 184 defining an acute angle relative to the inner wall 180 toward the proximal end 174 and a curved portion 186 coacting with the upper, lower, and inner walls to define an expansive aperture 188 near the distal end 172. The post 150 extends through a circular aperture 190 in the upper wall 176 and a circular aperture 192 in the lower wall 178. A bearing structure 194, through which the post 150 also extends, is mounted to and between the upper and lower walls 176, 178, near the proximal end 174. The bearing structure 194 comprises an upper bearing sleeve 196, a lower bearing sleeve 198, and a tubular spacer 200 between the bearing sleeves 196, 198. A bearing ring 202 is interposed around the post 150, between the upper clamp 152 and the upper wall 176. A bearing ring 204 is interposed around the post 150, between the lower clamp 154 and the lower wall 178.

At each perforating mechanism 100, an upper, generally L-shaped bracket 210 is welded to one of the clamping elements 156 of the upper clamp 152, and a lower, similar bracket 212 is welded to one of the clamping elements 160 of the lower clamp 154. An elongate pin 214 is mounted fixedly to the elongate housing structure 170 so that an upper portion 216 of the pin 214 extends upwardly from the upper wall 176 and so that a lower portion 218 thereof extends downwardly from the lower wall 178. The upper portion 216 has an annular groove 220. The lower portion 218 has an annular groove 222.

A coiled spring 224 has an outer end 226 wrapped around the upper portion 216 of the pin 214, at the annular groove 220, and an inner end 228 fastened to the upper bracket 210, by means of a fastener 230 of a type used conventionally with coiled springs. A coiled spring 232 has an outer end 234 wrapped around the lower portion 218 of the pin 214, at the annular groove 222, and an inner end 236 fastened to the lower bracket 212, by means of a fastener (not shown) similar to the fastener 230.

Figures 5, 6, 7, 8, 9:
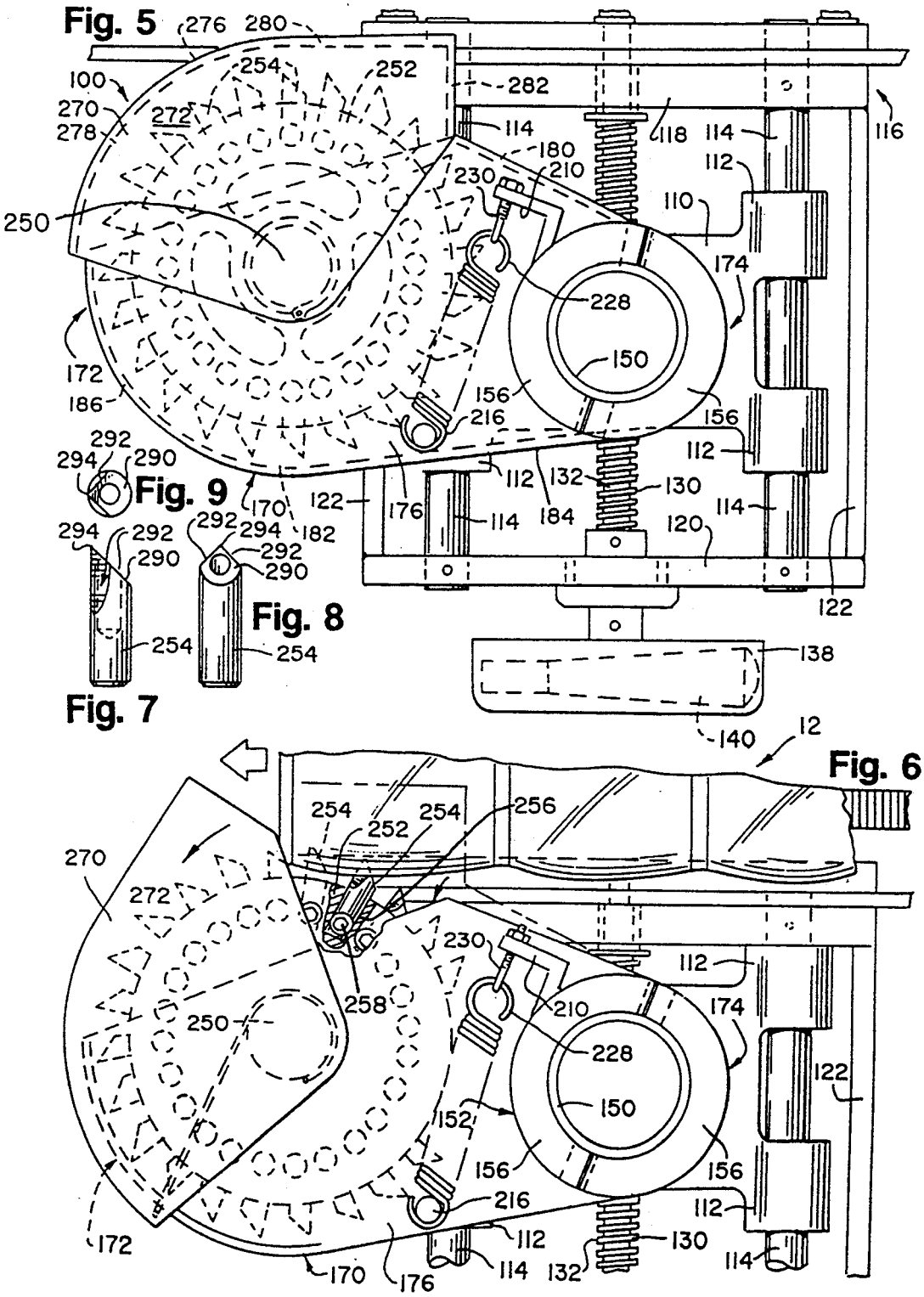
FIG. 5 is an enlarged, plan view of a pair of perforating mechanisms of one contemplated design useful in the wrapping apparatus, namely the nearer pair shown in FIGS. 1, 2, and 3.
FIG. 6 is a similar view of the perforating mechanisms of FIG. 5 with certain elements thereof in changed positions.
FIGS. 7, 8, and 9 are enlarged detail views of a perforating cutter representative of multiple cutters of the perforating mechanisms of FIGS. 5 and 6.
Figure 10:
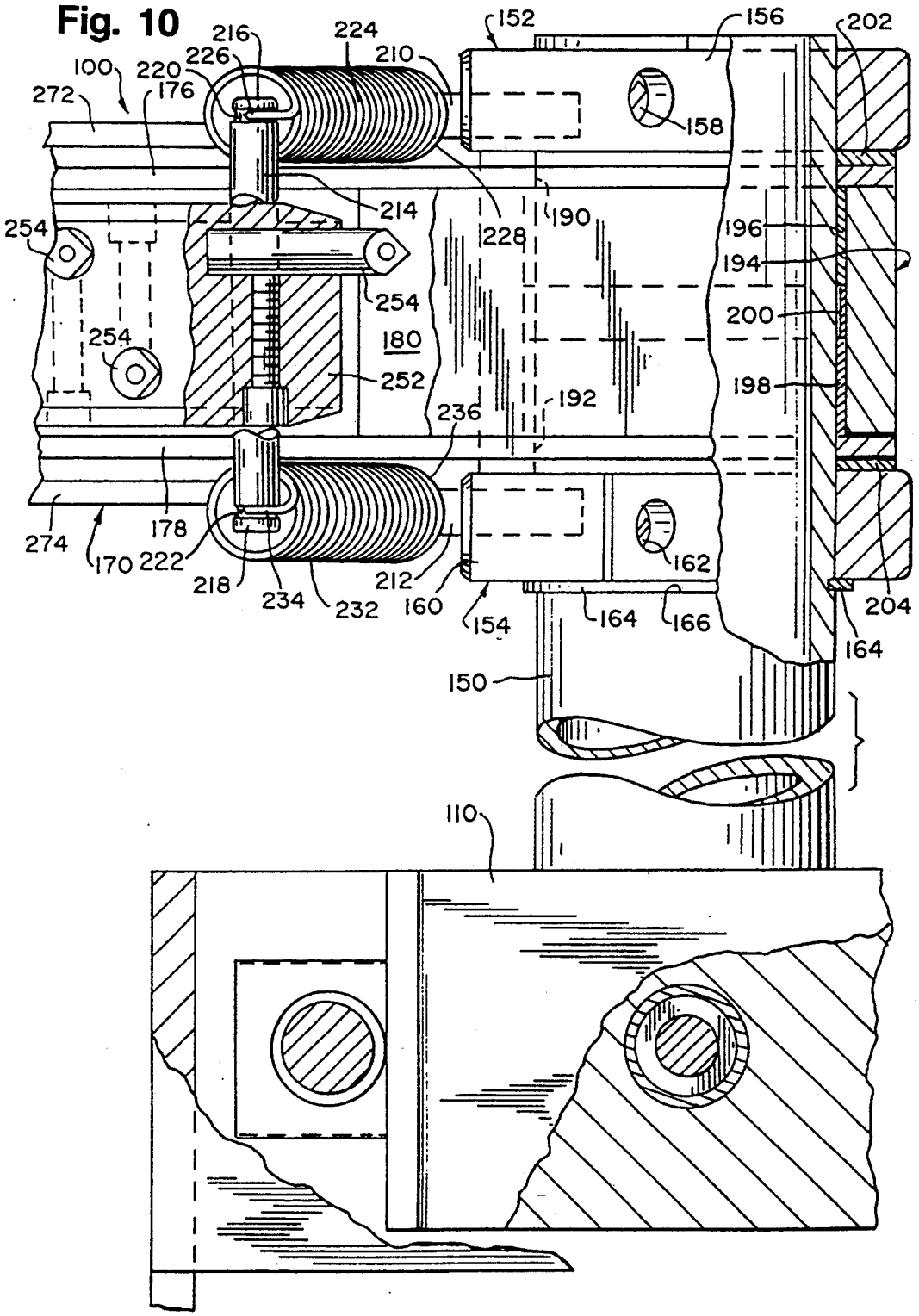
FIG. 10 is an enlarged, elevational view of the same pair of perforating mechanisms with certain elements sectioned partially or broken away to reveal other elements.

A cylindrical post 250, which is shown in dashed lines in FIGS. 5 and 6, extends vertically through the upper and lower walls 176, 178, of the elongate housing structure 170, near the distal end 172. A perforating wheel 252 is journalled on the post 250. The perforating wheel 252 carries multiple, similar, perforating cutters 254 in two circumferential arrays, namely an upper array and a lower array, as shown in FIG. 10. Each cutter 254 is mounted in a socket 256 in such wheel 252, so as to extend radially from the socket 256, and is retained therein by a set screw 258 threaded into a threaded socket 260 extending axially into such wheel 252. As shown, the perforating cutters 254 of the upper array alternate with the perforating cutters 254 of the other array, around the perforating wheel 252.

As shown, a shroud 270 has an upper wall 272 mounted to an upper end of the post 250, a lower wall 274 mounted to a lower end of the post 250, an outer wall 276 having a curved portion 278 and a planar portion 280, and an end wall 282 extending from the planar portion 280, between the upper and lower walls 272, 274. The shroud 270 is rotatable on the post 250, in external relation to the elongate housing structure 170, between a covering position (see FIG. 5) wherein the shroud 270 covers the aperture 188 of the elongate housing structure 170 fully and an uncovering position wherein the shroud 270 uncovers the aperture 188 fully, over a range of intermediate positions (see FIG. 6 for one example) wherein the shroud 270 uncovers the aperture 188 partially.

In a typical operation of the perforating mechanisms 100, the base 110 is adjusted from a position (see FIG. 5) wherein the perforating mechanisms 100 are removed in a lateral direction to a position (see FIG. 6) wherein the shroud 270 of each mechanism 100 is engaged by a corner portion of a cotton bale 12 as the bale 12 is conveyed in a frontward direction indicated by a wide arrow. Thus, the shroud 270 of such mechanism 100 is pivoted to an intermediate position wherein several of the perforating cutters 254 in each circumferential array are exposed at any instant, whereupon the perforating wheel 252 is rotated so that some of the cutters 254 exposed at any instant perforate the film wrapping of the bale 12 as the bale 12 is conveyed past the perforating mechanisms 100. Such cutters 254 form generally V-shaped perforations 102 in such film. The coiled springs 224, 232, bias the perforating mechanisms 100 pivotally on the post 150, toward the bale 12 being conveyed past such mechanisms 100.

As shown in FIGS. 7, 8, and 9, each cutter 254 is machined from tubular steel stock so as to have a bevelled surface 290 and two curved surfaces 292 coacting with the bevelled surface 290 to define a sharp point 294. The curved surfaces 292 permit such cutter 254 to penetrate the film wrapping a load, such as a cotton bale 12, and to withdraw from such film without binding.

Preferably, the cutters 254 are oriented so that the perforations 102 formed in such film point toward the front face 14 of the bale 12. Thereupon, when the bale 12 leaves the apparatus 10, in a manner illustrated in FIG. 2, such face 14 becomes the bottom face of the bale.

A pair of perforating mechanisms 300 according to an alternative, preferred design is shown in FIGS. 11 through 15. As shown, the perforating mechanisms 300 have structures that may be generally characterized as right-handed, so as to be thus substitutable for the perforating mechanisms 100 of the nearer pair shown in FIGS. 1, 2, and 3. A pair of perforating mechanisms (not shown) similar to the perforating mechanisms 300 but having structures that may be generally characterized as left-handed are provided also, so as to be thus substitutable for the perforating mechanisms 100 of the other pair. Moreover, except as illustrated in FIGS. 11 through 15 and described herein, the perforating mechanisms 300 are similar to the perforating mechanisms 100.

The perforating mechanisms 300 are mounted to a base 310. The base 310 has two pairs of sleeve portions 312, which are mounted slidably on two parallel bars 314. The bars 314 are mounted to the framework 34 of the apparatus 10 so as to extend laterally from the framework 34. A box-like frame 316 including an inner member 318, an outer member 320, and two members 322 extending between the inner and outer members 318, 320 is affixed to the bars 314.

A shaft 330 parallel to the bars 314 and disposed between the bars 314 extends from a back wall 332 of the base 310, freely through an opening 334 in a front wall 336 of the base 310, and freely through an opening (not shown) in the outer member 320 of the frame 316. The inner end of the shaft 330 is secured to the back wall 332. A disc 340 larger than the opening in the outer member 320 is secured to the outer end of the shaft 330, so as to limit inward movement of the shaft 330 relative to the outer member 320. A coiled compression spring 342 disposed around the shaft 330 extends freely through the opening 334 in the front wall 336, between the back wall 332 and the outer member 320, so as to bias the base 310 along the shaft 330 and the bars 314.

A tubular post 350 defining a vertical axis extends upwardly from the base 310. The perforating mechanisms 300 are mounted on the post 350, in vertically spaced relation to each other, so as to be independently pivotable about the axis defined by the post 350. Each perforating mechanism 300 is mounted on the post 350, between an upper clamp 352 and a lower clamp 354, in a manner similar to the manner wherein each perforating mechanism 100 is mounted on the associated post 150.

Moreover, each perforating mechanism 300 comprises an elongate housing structure 370 having a distal end 372 and a proximal end 374, near which such structure 370 is mounted pivotally on the post 350 in a manner similar to the manner wherein the elongate housing structure 170 of each perforating mechanism 100 is mounted on the associated post 150. Such structure has an upper wall 376 and a lower wall 378. In each perforating mechanism 300, a coiled spring 380 is mounted to the upper clamp 352, by means of a bracket 382 and a fastener 384, and to the elongate housing structure 370, by means of a pin 386, in a manner similar to the manner wherein each of the coiled springs 224, 226, is mounted in a respective one of the perforating mechanisms 100.

In each perforating mechanism 300, a cylindrical post 390 extends vertically through suitable apertures in the upper and lower walls 376, 380, of the elongate housing structure 370. The post 390 has a deep, cylindrical socket 392 opening upwardly, a lower, annular flange 394 extending radially outwardly, and an upper, annular recess 396. Screws 398 passing through suitable apertures in the annular flange 394, into threaded apertures in the lower wall 378, secure the post 390 to the elongate housing structure 370. A perforating wheel 400 similar to each of the perforating wheels 252 is journalled on the cylindrical post 390, by means of an upper bearing sleeve 402 and a lower bearing sleeve 404 with a bearing ring 406 above the upper bearing sleeve 402 and two bearing rings 408 below the lower bearing sleeve 404. The perforating wheel 400 carries multiple perforating cutters 410 similar to the perforating cutters 254 and arranged in similar upper and lower arrays wherein the perforating cutters 410 of the upper array alternate with the perforating cutters 410 of the lower array.

As shown, a shroud 420 having an upper wall 422 and a curved, outer wall 424 with an undulating outer surface 426 along a portion of the outer wall 424 is rotatable on the post 390, in internal relation to the elongate housing structure 370. A cap 430 having a lower, annular flange 432 extending radially outwardly is welded to the shroud 420 at the outer edge of such flange 432. The cap 430 is disposed rotatably on the post 390, within the upper, annular recess 396, and extends upwardly through a circular aperture in the upper wall 376 of the elongate housing structure 370, so as to permit relative rotation of the cap 430 and the shroud 420 relative to such structure 370. The cap 430 has a conventional lubricating fitting 434.

A coiled torsion spring 440 is disposed within the socket 392 of the post 390. An upper end 442 of the spring 440 is curved and fits upwardly into a curved slot 444 opening upwardly into the cap 430 so that such end 442 rotates conjointly with the cap 430 and with the shroud 420. A lower end 446 of the spring 440 is straight and fits downwardly into a hole 448 drilled through the lower end of the post 390 so that such end 446 is anchored to the post 390. When the perforating mechanism 300 is assembled, the spring 440 is pretwisted to bias the shroud 420 on the post 390, toward a covering position (see FIG. 13) similar to the covering position of each shroud 270. However, the spring 440 permits the shroud 420 to rotate on the post 390, from the covering position to an uncovering position (see FIGS. 11 and 14) similar to the uncovering position of each shroud 270.

A cylindrical stop 450 is secured by a screw 452 to the shroud 420. The upper wall 376 of the elongate housing structure 370 has, at a suitable location, an arcuate recess 454 conforming to the cylindrical stop 450. When the shroud 420 is rotated to its uncovering position, the cylindrical stop 450 engages such wall 376 and fits into the arcuate recess 454, so as to prevent further rotation of the shroud 420 relative to the elongate housing structure 370.

As shown in FIGS. 11 and 12, a positioning wheel 460 is journalled on a shaft 462, which is supported by an upper arm 464 and a lower arm 466. The upper arm 464 is welded to the lower clamp 354 mounting the lower perforating mechanism 300. The lower arm 466 is welded to a similar clamp 461, which is clamped to the post 350, at a suitable distance below the upper arm 464. The positioning wheel 460 is made of a suitable, polymeric material, so as not to require lubrication. The positioning wheel 460 has a diameter equal approximately to the diameters of the perforating wheels 400 excluding the perforating cutters 420. As shown in FIG. 11, the positioning wheel 460 is coaxial with the perforating wheels 400 at certain positions of the perforating wheels 400.

As a bale 12 is conveyed past the perforating mechanisms 300, the positioning wheel 460 engages the bale 12 and rolls along the bale 12. Also, the bale 12 moves the positioning wheel 460 outwardly, along with the base 310 and the perforating mechanisms 300 and against the coiled compression spring 342 biasing the base 310 inwardly, as necessary to accommodate the width of the bale 12 where the positioning wheel 460 engages the bale 12 and any irregularities in such width. When a corner portion of the bale 12 engages the shroud 420 at the undulating outer surface 426, which enhances friction between the bale 12 and the shroud 420, the bale 12 rotates the shroud 420 from its covering position to an intermediate position wherein several of the perforating cutters 410 are exposed at any instant. In other respects, the perforating mechanisms 300 operate in a manner similar to the manner wherein the perforating mechanisms 100 operate.

Various modifications may be made in the apparatus and perforating mechanisms described above without departing from the scope and spirit of this invention, which is defined by means of the appended claims. It is therefore to be understood that within the scope of the appended claims, the present invention may be practiced otherwise than as specifically described herein.

We claim:

1. A method for wrapping an elongate load, conforming generally to a rectangular solid and having a front face, a back face, an elongate upper face, an elongate lower face, and two elongate lateral faces, with wrapping film from first, second, and third rolls, with said first and second rolls being rotatable about fixed, parallel axes, comprising the steps of:

welding a length of film from said first roll, and a length of film from said second roll, to each other, by a first welding means, so as to form a predraped wall of film having a first welded seam in front of said load to be wrapped;

conveying said load to be wrapped into said predraped wall, in a frontward direction, so as to cover said front face and two elongate faces of said load to be wrapped with film from said welded lengths of film;

welding said welded lengths of film again to each other, by said first welding means, so as to form a second welded seam behind said covered load and thereby cover said back face of said load with film from said welded lengths of film;

severing said welded lengths of film from said first and second rolls of film at a location near said second welded seam behind said covered load;

conveying said covered load, having said first and second welded seams, further in said frontward direction relative to said third roll of film while wrapping a length of film from said third roll of film in a spiral pattern around said covered load and over said film covering said two elongate faces of said covered load so as to cover said elongate upper, lower, and lateral faces of said covered load with film from said third roll of film;

welding said spirally wrapped film from said third roll of film to a portion of said welded lengths of film from said first and second rolls of film, by a second welding means, along one of said elongate upper, lower, and lateral faces of said covered load during conveyance of said covered load in said frontward direction; and severing said spirally wrapped film, welded to said portion of said welded lengths of film from said first and second rolls of film, from said third roll of film.

2. The method of claim 1, wherein:

said elongate faces of said load which are covered with said film from said welded lengths of film from said first and second rolls are the upper and lower faces.

3. The method of claim 1 wherein the film lengths welded again to each other are welded so as to form two spaced, parallel, welded seams behind the load and are severed from the first and second rolls between the welded seams behind the load.

4. The method of claim 1 further comprising a step of perforating the film in areas along at least one of the elongate faces of the load while the load is being conveyed.

5. The method of claim 4 wherein the film is perforated so as to provide the film with generally V-shaped perforations pointing toward the front face.

6. The method of claim 4 wherein the film is perforated along both of the lateral faces.

7. The method of claim 6 wherein the elongate faces covered with film from the welded lengths of film are the upper and lower faces.

8. The method as set forth in claim 4, wherein:

said covering of said load with said welded lengths of film from said first and second rolls of film is performed at a first predraping and wrapping station;

said spiral wrapping of said load with said film from said third roll of film is performed at a second spiral wrapping station located downstream of said first predraping and wrapping station as viewed in said frontward direction; and said welding of said spirally wrapped film and said perforating of said film is performed at a third welding and perforating station located downstream of said second spiral wrapping station as viewed in said frontward direction.

9. Apparatus for wrapping an elongate load conforming generally to a rectangular solid and having a front face, a back face, an elongate upper face, an elongate lower face, and two elongate lateral faces, with wrapping film from first, second, and third rolls of film, comprising:

means for mounting said first and second rolls of film so that said first and second rolls of film are rotatable about fixed, parallel axes, and so that film can be pulled from said first and second rolls of film;

first means for conveying said load in a frontward direction;

first means for welding a length of film from said first roll of film and a length of film from said second roll of film to each other so as to form a predraped wall of film, having a first welded seam disposed in front of said load to be wrapped, into which said load is moved by said first conveying means when said first conveying means moves said load to be wrapped in said frontward direction so as to cover said front face and two elongate faces of said load with film from said welded lengths of film; for welding said welded lengths of film again to each other so as to form a second welded seam behind said covered load and thereby cover said back face of said load with film from said welded lengths of film, as said first conveying means moves said load further in said frontward direction; and for severing said welded lengths of film from said first and second rolls of film at a location near said second welded seam behind said covered load;

second means for conveying said covered load, having said first and second welded seams, in said frontward direction relative to said third roll of film;

means for wrapping a length of wrapping film from said third roll of film in a spiral pattern around said covered load and over said film covering said two elongate faces of said load so as to cover said upper, lower, and lateral faces of said load with said film from said third roll of film;

second means for welding said spirally wrapped film from said third roll of film to a portion of said welded lengths of film from said first and second rolls of film which cover said load along one of said elongate upper, lower, and lateral faces of said covered load and in a direction extending parallel to said frontward direction during conveyance of said covered load in said frontward direction; and means for severing said welded spirally wrapped film, welded to said portion of said welded lengths of film from said first and second rolls of film, from said third roll of film.

10. The apparatus of claim 9 wherein the first conveying means is operative for conveying the load into the predraped wall of film so as to cover the front, upper and lower faces with film from the welded lengths.

11. Apparatus as set forth in claim 9, wherein:

said first welding and severing means comprises an anvil disposed upon one side of said load, and a welding and cutting head reciprocatingly disposed upon an opposite side of said load so as to be movable toward and away from said anvil in a direction substantially perpendicular to said frontward direction of movement of said load by said conveying means.

12. Apparatus as set forth in claim 9, wherein:

said second welding means comprises a rotary drum having heating means defined within peripheral portions of said drum for engaging said lower face of said load as said load is conveyed by said conveying means in said frontward direction.

13. The apparatus of claim 9 further comprising means for perforating the film at locations along each lateral face while the load is being conveyed.

14. The apparatus of claim 9 further comprising means for perforating the film with generally V-shaped perforations, which point toward the front face of the load, at locations along each lateral face while the load is being conveyed.

15. The apparatus of claim 9 further comprising means for perforating the film at locations along at least one elongate face while the load is being conveyed.

16. Apparatus as set forth in claim 15, further comprising:

means defining a first predraping and wrapping station at which said covering of said load with said welded lengths of film from said first and second rolls of film is performed;

means defining a second spiral wrapping station, disposed downstream of said first predraping and wrapping station as viewed in said frontward direction, at which said spiral wrapping of said load with said film from said third roll of film is performed; and means defining a third welding and perforating station, disposed downstream of said second spiral wrapping station as viewed in said frontward direction, at which said welding of said spirally wrapped film and said perforating of said film is performed.

17. Apparatus as set forth in claim 15, wherein:

said means for perforating said film comprises at least one perforating wheel having a plurality of perforating cutters and rotatably movable about an axis which is disposed perpendicular to said frontward direction.

18. Apparatus as set forth in claim 17, wherein:

said plurality of perforating cutters are disposed upon said at least one perforating wheel in two alternating circumferential arrays.

19. Apparatus as set forth in claim 17, further comprising:

spring biasing means for biasing said at least one perforating wheel into contact with said wrapped load so as to permit said plurality of perforating cutters to form perforations within said film wrapping said load.

20. Apparatus as set forth in claim 17, wherein:

said at least one perforating wheel comprises two axially spaced perforating wheels.

21. Apparatus as set forth in claim 20, wherein:

said plurality of perforating cutters are disposed upon each one of said two axially spaced perforating wheels in two alternating circumferential arrays.

22. Apparatus as set forth in claim 20, further comprising:

spring biasing means for biasing said two axially spaced perforating wheels into contact with said wrapped load so as to permit said plurality of perforating cutters to form perforations within said film wrapping said load.

* * * * *